United States Patent [19]

Zieke

[11] Patent Number: 4,812,056

[45] Date of Patent: Mar. 14, 1989

[54] RECLOSABLE, FLEXIBLE CONTAINER HAVING AN EXTERNALLY OPERATED FASTENER

[75] Inventor: Larry M. Zieke, Midland, Mich.

[73] Assignee: The Dow Chemical Company, Midland, Mich.

[21] Appl. No.: 715,562

[22] Filed: Mar. 25, 1985

[51] Int. Cl.[4] ..... B65D 33/16

[52] U.S. Cl. ..... 383/65; 24/587; 24/606; 292/19; 383/95

[58] Field of Search ..... 383/63, 65, 95; 24/606, 24/615, 633, 656, 559, 587, 30.5 S; 292/17, 19, 87

[56] References Cited

U.S. PATENT DOCUMENTS

| | | | |
|---|---|---|---|
| Re. 28,969 | 9/1976 | Naito | 383/65 |
| 2,823,721 | 2/1958 | Svec et al. | 383/65 |
| 2,916,197 | 12/1959 | Petrie et al. | 383/63 X |
| 3,347,298 | 10/1967 | Ausnit et al. | 383/65 |
| 3,532,571 | 10/1970 | Ausnit | 383/65 X |
| 3,608,439 | 9/1971 | Ausnit | 383/63 X |

*Primary Examiner*—Stephen Marcus
*Assistant Examiner*—Bryon Gehman

[57] ABSTRACT

Improved reclosable, flexible containers having an internal fastening element wherein the improvement comprises an external opener for disengaging the internal fastening element.

7 Claims, 2 Drawing Sheets

RECLOSABLE, FLEXIBLE CONTAINER HAVING AN EXTERNALLY OPERATED FASTENER

BACKGROUND OF THE INVENTION

The present invention relates to reclosable, flexible containers, specifically, the present invention relates to an externally operated fastener for use on reclosable, flexible containers.

Reclosable, flexible containers are well-known in the prior art. Such containers normally comprise a pouch-like structure made of a thermoplastic resinous film. The pouch-like structure is normally sealed on three sides. The fourth unsealed side defines an opening to the interior of the pouch-like structure. The interior surfaces of the opening defined by the fourth side of the pouch-like structure have fastening means attached thereto. The fastening means are designed so as to be able to effect a closure or seal of the opening to the interior of the pouch-like structure. Typically, the fastening means comprise a male element and a female element. The male element and female element are designed so as to be capable of being releasably, interlockingly joined together. Exemplary fastening means are described in U.S. Pat. Nos. 2,637,085; 2,746,502; 3,173,184; 3,338,284; and Re. 28,969.

Prior art fasteners generally operate by squeezing the male and female elements together with a force sufficient to releasably, interlockingly join the male and female elements. This pressure is normally asserted along the entire length of the opening of the pouch-like structure. The pouch-like structure is thereby effectively sealed.

The seal on the pouch-like structure is typically released by exerting a force on opposing faces of the sealed edge of the pouch-like structure, said force being sufficient to separate the male and female elements.

In practice, prior art fasteners result in the entrappment of a quantity of air within the pouch-like structure. In many instances it is desirable to evacuate a portion of the air entrapped within the pouch-like structure. When employing prior art fasteners it has been necessary to entirely disengage the male and female elements in order to evacuate a portion of the entrapped air. This procedure is inconvenient and of times difficult in view of the material contained within the pouch-like structure.

It is desirable to provide a reclosable, flexible container capable of having air entrapped therein quickly and conveniently evacuated.

Prior art fasteners have been disengaged by exerting a force sufficient to pull the male and female elements away from one another thus placing them in a non-interlocking position. Because of the desirability of being able to disengage the male and female elements prior art fasteners have been designed to open upon the assertion of a relatively low level of force. Because of their ability to be opened by the exertion of a relatively low level of force, prior art fasteners have suffered from the disadvantage of unintentional opening due to forces exerted by material contained within the pouch-like structure. Some prior art fasteners have sought to overcome this disadvantage by designing fasteners that open more easily from the outside than from the inside.

It is desirable to produce a fastening means which seals with sufficient strength to prevent unintentional opening while at the same time being relatively easily resealable.

It is to these goals that the present invention is directed.

SUMMARY OF THE INVENTION

The present invention concerns a reclosable, flexible container comprising:

(1) a pair of opposing facing generally parallel supporting walls joined at their edges to form a pouch-like structure having a least one pair of unjoined edges thereby defining an opening to the interior of th pouch-like structure;

(2) a first mating closure element on the inner surface of one of the walls forming a part of the wall and projecting therefrom;

(3) a second mating closure element on the inner surface of the other wall forming a part of the wall and projecting therefrom, said second mating closure element facing said first mating closure element and being located so as to releasably, interlockingly receive the first mating closure element thereby joining the heretofore unjoined edges of the pouch-like structure; and (4) disengaging means for at least partially disengaging the second mating closure element from an interlocking relationship with the first mating closure element, said disengaging means being located on the outer surface of the supporting wall on which the second mating closure element is located, said disengaging means forming a part of the wall and projecting therefrom.

DETAILED DESCRIPTION OF THE DRAWINGS

Figure 1:
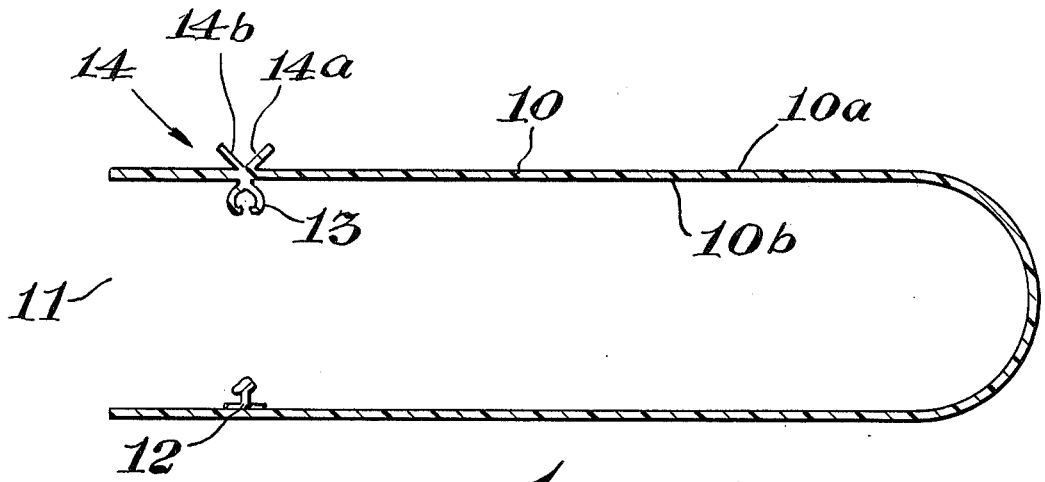
FIG. 1 is a longitudinal cross-sectional view of a flexible container according to the present invention.
Figure 2:
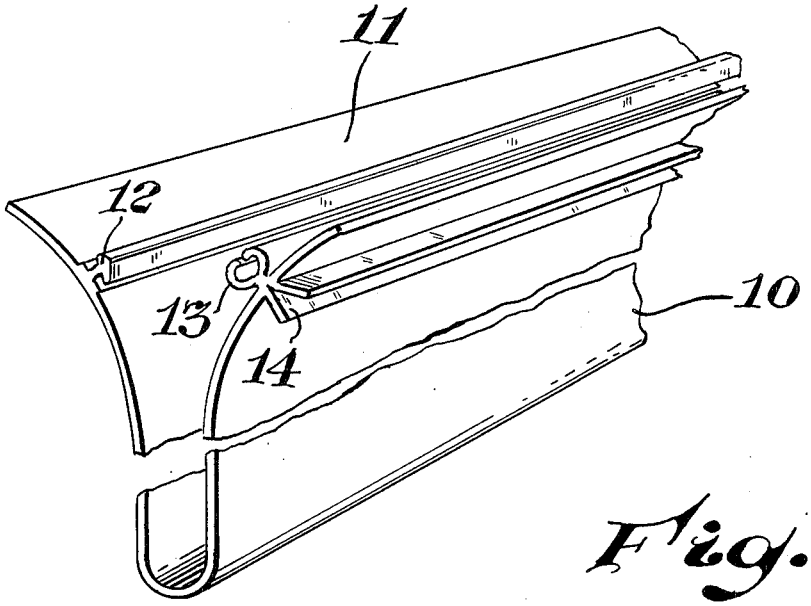
FIG. 2 is a perspective view of a container according to the present invention.

FIG. 1 illustrates a longitudinal cross-sectional view of the flexible containers according to the present invention. The flexible containers according to the present invention comprise a body 10 of a flexible thermoplastic resinous film. Any thermoplastic resin capable of forming a film is suitable for use in the present invention. The thermoplastic resinous film chosen for use in a particular case varies according to the end use desired for the flexible container. Similarly, the thickness of the film body 10 is dependent upon the desired end use for the flexible container. The thermoplastic resin and thickness of the film formed therefrom are chosen to provide adequate tensile strength, tear strength, pressure resistance, impact strength, and the like, for the end use desired for the flexible containers formed from the thermoplastic resinous film. Thermoplastic resins suitable for use in the present invention include low or high density polyethylene, linear low density polyethylene, polypropylene, nylon, and interpolymers of ethylene and one or more monomers copolymerizable therewith.

While the thickness of film body 10 is chosen in relation to the composition of the thermoplastic resin from which it is formed to provide necessary physical properties for the intended end use of the flexible container, suitable thicknesses generally fall within the range of from about 1 to about 10 mils, preferably from about 1.5 to about 3 mils. The film body 10 can be formed from a single layer of thermoplastic resin or it may be formed as a multilayer structure having as many as a hundred or more layers.

As illustrated by FIG. 1, film body 10 has attached thereto a first mating closure element 12, a second mating closure element 13, and disengaging means 14. The first mating closure element 12 is shown in the form of an elongated rib or male element. The second mating closure element is shown in the form of an elongated groove or female element. Disengaging means 14 is shown in the form of a "V"-shaped wing element. The first mating closure element 12 and second mating closure element 13, are located on the inner surface of film body 10, are positioned so as to be capable of being brought into an interlocking position with one another, and are further located so as to seal opening 11 when brought into an interlocking relationship with one another.

Disengaging means or wings 14 are located on the outer surface of film body 10. Additionally, disengaging means 14 are located so as to be in an operable relationship with respect to the second mating closure element 13. In order to be in an operable relationship with the second mating closure element 13, disengaging means 14 must be located generally opposite of the second mating enclosure element 13.

Methods of producing the first mating closure element 12 and the second mating closure element 13 and placing them in a relationship with film body 10 are well-known in the art. Exemplary of such methods are U.S. Pat. Nos. 3,462,332; 4,263,079; and application Ser. No. 586,163 by Raymond Douglas Behr, filed May 5, 1984, which application has been recently allowed. Any method capable of forming first mating closure element 12 and second mating closure element 13 is suitable for use in the present invention. Moreover, any method capable of forming first mating closure element 12 and second mating closure element 13 is likewise suitable for forming disengaging means or wings 14. First mating closure element 12, second mating closure element 13, and disengaging means or wings 14 may be formed in a process separate from the process used to form film body 10 and later joined to film body 10 or, they may be formed in the same process used to form film body 10 or, one or more of them may be formed in the same process used to form film body 10 while one or more of them are formed in a process separate from the process used to form film body 10.

FIGS. 1–4 illustrate an embodiment of the present invention wherein disengaging means or wings 14 is formed in the same process as film body 10. This is evidenced by the fact that a portion of the area void of thermoplastic resinous material defined by the first interior surface 14*a*, and the second interior surface 14*b*, of disengaging means or wings 14 lies within the area defined by the generally planar outer surface 10*a* and generally planar inner surface 10*b* of film body 10. While FIGS. 1–4 illustrate an embodiment of the present invention wherein disengaging means or wings 14 is formed in the same process as film body 10, it may be possible to form a structure such as that depicted in FIGS. 1–4 other than by forming disengaging means or wings 14 and film body 10 in the same process.

A preferred embodiment of the present invention is to have a portion of the area void of thermoplastic material, defined by surfaces 14*a* and 14*b*, lie within the area defined by surfaces 10*a* and 10*b*. This allows for the more effective operation of disengaging means or wings 14.

Figure 3:
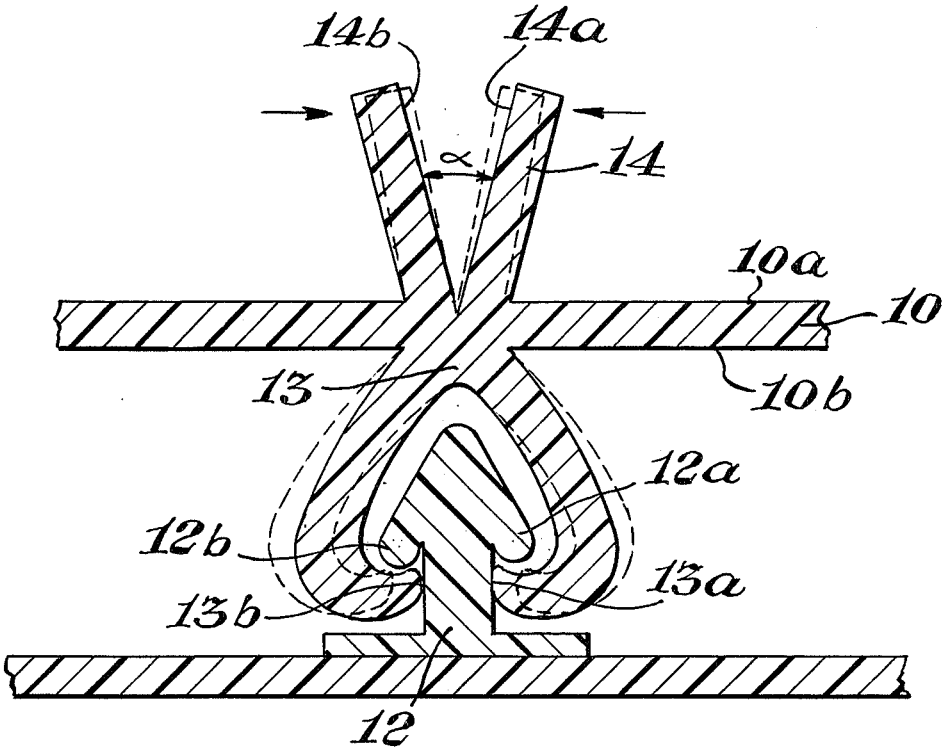
FIG. 3 is an enlarged longitudinal cross-sectional view of the first mating closure element, the second mating closure element, and the disengaging means of the flexible containers of the present invention. The solid lines depict the first mating closure element and the second mating closure element in an interlocked or closed position. The dotted lines depict the first mating closure element and the second mating closure element in a paritially disengaged position, said partially disengaged position being achieved by activating the disengaging means.

FIG. 3 represents an enlarged view of the fastening means according to the present invention. The solid line drawing in FIG. 3 shows the first mating closure element 12 in a releasably interlocking relationship with the second mating closure element 13. Materials, including air, on the interior of the flexible container are prevented from escaping the container by contact points 13*a* and 13*b* between the first mating closure element 12 and the second mating closure element 13. The first mating element 12 and the second mating closure element 13 are generally restrained from disengaging by lobe elements 12*a* and 12*b* which prevent the second mating closure element 13 from disengaging with the first mating closure element 12. The interior surfaces 14*a* and 14*b* of disengaging means or wings 14 define angle $\alpha$. Disengaging means or wings 14 are activated by applying opposing forces to the outer surfaces of disengaging means or wings 14 thereby decreasing angle $\alpha$ in a manner similar to a common wooden clothespin.

The dotted line drawing of FIG. 3 is a representation of the fastening means represented by the solid lines in FIG. 3 after disengaging means or wings 14 has been activated by applying opposing forces to the outer surfaces of disengaging means or wings 14 thereby reducing angle $\alpha$. The decrease in angle $\alpha$ has caused a widening of the second mating closure element 13. This widening of second mating closure element 13 has brought contact points 13*a* and 13*b* out of contact with first mating closure element 12. As can be seen from the dotted drawing of FIG. 3, material, particularly gaseous material, on the interior of the flexible container can now pass from the interior of the flexible container to the exterior of the flexible container. Nonetheless, it is to be noted that the first mating closure element 12 and the second mating closure element 13 are only partially disengaged any attempt to further disengage the first mating closure element 12 and second mating closure element 13 would be prevented by contact between second mating closure element 12 and lobe elements 12*a* and 12*b* on first mating closure element 12.

Figure 4:
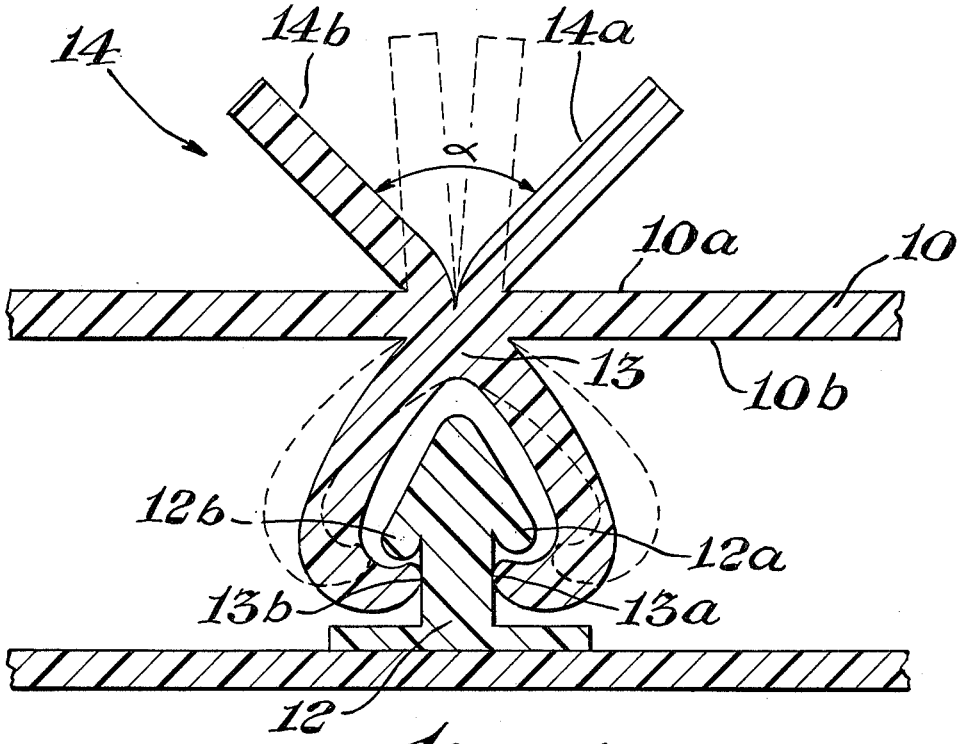
FIG. 4 is an enlarged longitudinal cross-sectional view of the first mating closure element, the second mating closure element, and the disengaging means of the flexible containers of the present invention. The solid lines depict the first mating closure element and the second mating closure element in a interlocked or closed position. The dotted lines depict the first mating closure element and the second mating closure element in a fully disengaged position, said fully disengaged position being achieved by activating the disengaging means.

FIG. 4 is an enlarged view of the fastening means according to the present invention. As in FIG. 3, the solid line drawing represents a situation in which first mating closure element 12 and second mating closure element 13 are shown in an interlocking position as evidenced by contact points 13*a* and 13*b* between first mating closure element 12 and second mating closure element 13. Comparison of the solid line drawings of FIG. 3 and FIG. 4 shows that angle $\alpha$ in FIG. 4 is nearly twice as large as angle in FIG. 3.

The dotted line drawing in FIG. 4 shows the fastening means depicted by the solid lines of FIG. 4 after disengaging means or wings 14 has been activated by applying opposing forces to the exterior surfaces of disengaging means or wings 14 thereby reducing angle $\alpha$. The dotted line drawing of FIG. 4 shows first mating closure element 12 and second mating closure element 13 in essentially a completely disengaged relationship since lobe elements 12*a* and 12*b* on first mating closure element 12 will not contact any portion of second mating closure element 13 if second mating closure element 13 and first mating closure element 12 are moved apart.

As can be seen from comparison of FIGS. 3 and 4, if all else remains constant, it is the amount by which angle is decreased in the step of activating disengaging means or wings 14 which determines whether first mating closure element 12 and second mating closure element 13 will be partially disengaged or fully disengaged.

The drawings and specification present a detailed disclosure of the preferred embodiments of the present invention. It is to be understood that the invention is not limited to the specific forms disclosed, but covers all modifications, changes, and alternative constructions and methods falling within the scope of the principals taught by the present invention.

What is claimed is:

1. A reclosable, flexible container comprising:

(1) a pair of opposing facing generally parallel supporting walls joined at their edges to form a pouch-like structure having at least one pair of unjoined edges thereby defining an opening to the interior of the pouch-like structure;

(2) a first mating closure element on the inner surface of one of the walls forming a part of the wall and projecting therefrom;

(3) a second mating closure element on the inner surface of the other wall forming a part of the wall and projecting therefrom, said second mating closure element facing said first mating closure element and being located so as to releasably, interlockingly receive the first mating closure element thereby joining the heretofore unjoined edges of the pouch-like structure; and (4) disengaging means for at least partially disengaging the second mating closure element from an interlocking relationship with the first mating closure element, said disengaging means comprising a means for increasing the width of the second mating closure element, said disengaging means being located on the outer surface of the supporting wall on which the second mating closure element is located, said disengaging means forming a part of the wall and projecting therefrom.

2. The container of claim 1 wherein the means for increasing the width of the second mating closure element comprises a "V"-shaped element located generally opposite of the second mating closure element and of a size such that when the outer surfaces of the "V"-shaped element are drawn together, the width of the second mating closure element increases.

3. The container of claim 1 comprising the additional element of integral flange elements forming continuation of said supporting walls projecting above the first and second mating closure elements with the first and second mating closure elements being spaced from the edges of the walls and being separable by drawing the flanges apart from above the first and second mating closure element.

4. The container of claim 1 wherein the first mating closure element is in the form of an elongated rib and the second mating closure element is in the form of an elongated groove element.

5. The container of claim 1 wherein the supporting walls are formed from a thermoplastic resin.

6. The container of claim 5 wherein the thermoplastic resin is selected from the group consisting of low density polyethylene, high density polyethylene, linear low density polyethylene, polypropylene, nylon, and interpolymers of ethylene and one or more monomers copolymerizable therewith.

7. The container of claim 6 wherein the supporting walls are formed from low density polyethylene.

* * * * *

UNITED STATES PATENT AND TRADEMARK OFFICE

CERTIFICATE OF CORRECTION

PATENT NO. : 4,812,056

DATED : March 14, 1989

INVENTOR(S) : Larry M. Zieke

It is certified that error appears in the above-identified patent and that said Letters Patent is hereby corrected as shown below:

Column 1, line 47, "of times" should read --oftimes--.

Column 2, line 12, "th" should read --the--.

Column 4, line 31, following the word "mating" insert therefor --closure--.

Signed and Sealed this

Nineteenth Day of December, 1989

*Attest:*

JEFFREY M. SAMUELS

*Attesting Officer*

*Acting Commissioner of Patents and Trademarks*